US006079454A

United States Patent [19]

Lee et al.

[11] Patent Number: 6,079,454

[45] Date of Patent: Jun. 27, 2000

[54] LOOP/TIE-BACK WOVEN LOOP SEAM PRESS BASE

[75] Inventors: Henry J. Lee, Summerville; Billy Summer, Joanna, both of S.C.

[73] Assignee: AstenJohnson, Inc., Charleston, S.C.

[21] Appl. No.: 08/976,885

[22] Filed: Nov. 24, 1997

[51] Int. Cl.[7] ..... D21F 1/00; D03D 13/00

[52] U.S. Cl. ..... 139/383 AA; 428/193; 428/58; 28/141; 162/904; 442/225; 442/270

[58] Field of Search ..... 428/193, 58; 28/141; 139/383 AA; 162/904; 442/225, 270

[56] References Cited

U.S. PATENT DOCUMENTS

| | | | |
|---|---|---|---|
| 3,815,645 | 6/1974 | Codorniu . | |
| 4,026,331 | 5/1977 | Lees et al. | 139/383 AA |
| 4,071,050 | 1/1978 | Codorniu . | |
| 4,095,622 | 6/1978 | MacBean | 139/383 AA |
| 4,103,717 | 8/1978 | Clark | 139/383 A |
| 4,438,788 | 3/1984 | Harwood | 139/383 A |
| 4,438,789 | 3/1984 | MacBean | 139/383 AA |
| 4,658,863 | 4/1987 | Errecart . | |
| 5,089,234 | 2/1992 | Jackson | 139/383 AA |
| 5,110,672 | 5/1992 | Zehle et al. | 139/383 AA |
| 5,188,884 | 2/1993 | Smith | 139/383 AA |
| 5,238,027 | 8/1993 | Lee | 139/383 AA |
| 5,458,161 | 10/1995 | Scarfe | 139/383 AA |
| 5,458,693 | 10/1995 | Codorniu . | |
| 5,601,120 | 2/1997 | Kuckart et al. | 139/383 AA |
| 5,769,131 | 6/1998 | Whitlock et al. | 139/383 AA |

FOREIGN PATENT DOCUMENTS

| | | |
|---|---|---|
| 0182597 | 5/1986 | European Pat. Off. . |
| 0341043 | 11/1989 | European Pat. Off. . |
| 0612882 | 8/1994 | European Pat. Off. . |

*Primary Examiner*—Andy Falik
*Attorney, Agent, or Firm*—Volpe and Koenig, P.C.

[57] ABSTRACT

An opened ended, endless woven papermaker's fabric having a plurality of longitudinal yarns and a plurality of transverse yarns woven in a selected weave pattern to form a fabric body and seaming loops, the fabric characterized by a longitudinal yarn weave repeat having selected yarns woven as the seaming loops and selected yarns woven in the fabric body and defining a fabric edge.

6 Claims, 6 Drawing Sheets

LOOP/TIE-BACK WOVEN LOOP SEAM PRESS BASE

BACKGROUND OF THE INVENTION

1. Field of the Invention

The present invention generally relates to a woven fabric which is designed for use in a papermaking, cellulose or board manufacturing machine and which along each end has a plurality of loops to be included in a loop seam to form an endless woven fabric.

2. Description of the Prior Art

As will be known to those skilled in the art, papermaking machines generally include three sections which are generally referred to as the formation, press and dryer sections. The present invention finds particular application in papermaker's felts which are employed in the press section of a papermaking machine.

Typically, such felts include a supporting base, and a paper carrying or supporting layer fixed to the base. Frequently, the base fabric is a woven fabric which is used as an endless belt. The woven fabric may be woven as an endless loop and utilized as such so there is no seam or, alternatively, the fabric may be woven to have two ends which are joined at a seam to form the endless loop. Various seams are known in the art, including pin type seams which utilize a joining wire or pintle which is inserted through seam loops at each end of the fabric to render it endless.

One technique of forming a fabric having seam loops is to provide an endless weave wherein loops are formed by weaving stacked weft yarns around a forming wire, as shown in U.S. Pat. No. 3,815,645. A common problem associated with this type of loop formation is non-uniform loop alignment, both in the vertical and horizontal axis, when the forming wire is removed. The misalignment creates a seam that is difficult to mesh.

FIGS. 1–3 show representative loop misalignments experienced in common prior art endless woven seams. Generally, as a loom weaves the loops in an endless weave, it naturally offsets the returning weft position slightly from its outgoing weft position. Therefore, it is necessary to maintain the weft yarns in a stacked relationship throughout the fabric through the balanced weave of the warp yarns. The last warp yarn, however, is generally not balanced by adjacent yarns on each side and therefore, an unbalanced crimp force is applied to the weft yarns in the loop area, as shown by the arrows in FIG. 2. As a result, the two weft yarn passes which form each loop are not balanced by warps and the loops tend to be misaligned.

Another problem associated with standard seams is that the seam area has a yarn density twice that of the body since each meshed seam half has a density similar to the body.

Accordingly, it is desired to provide a base fabric having seam loops which are easier to intermesh and more uniform fabric characteristics in the seam area.

SUMMARY OF THE INVENTION

The present invention provides an open ended papermaker's fabric having a system of transverse yarns interwoven with a system of longitudinal yarns. Select longitudinal yarns at each end of the fabric are woven to form seam loops while other longitudinal yarns at each end of the fabric are woven around a yarn of the transverse yarn system to form integral edge tiebacks.

DESCRIPTION OF THE PREFERRED EMBODIMENT

Figure 1:
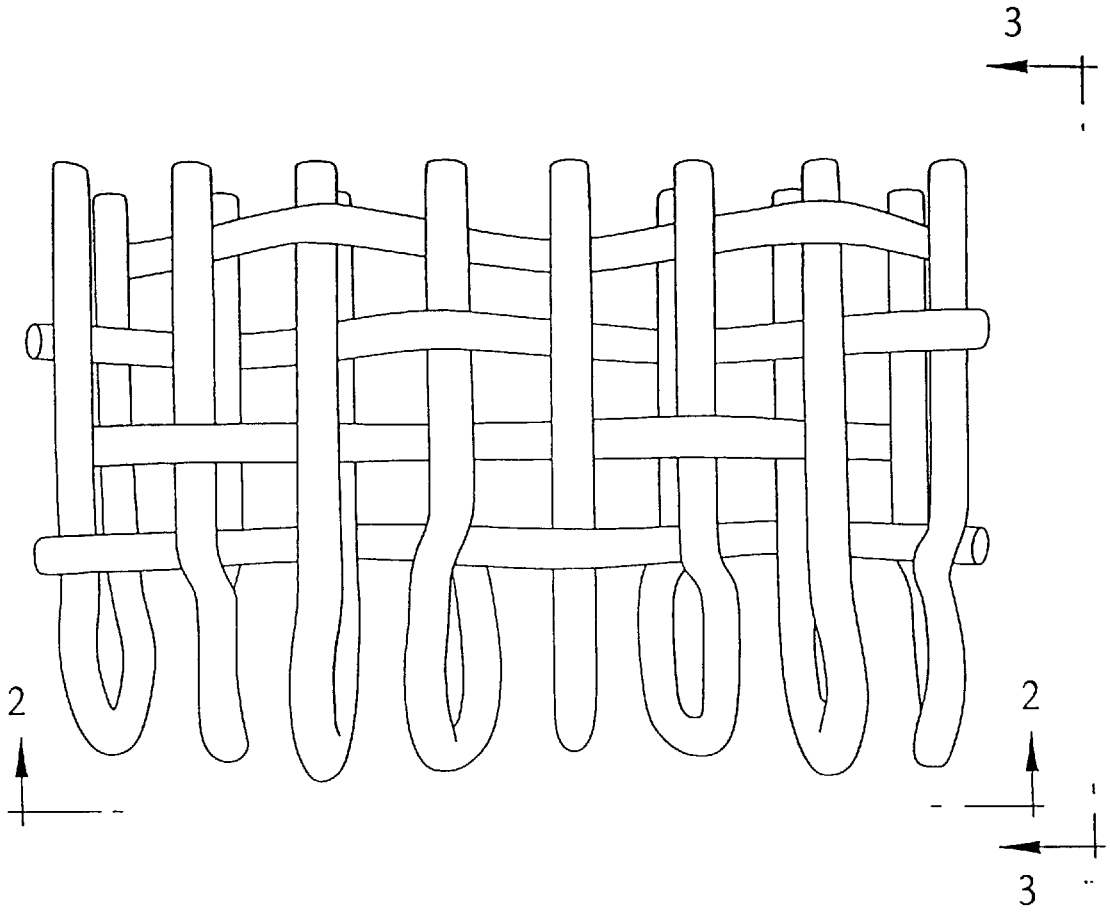
FIG. 1 (PRIOR ART)
FIG. 1 is a top plan view of prior art end loops.
Figure 2:
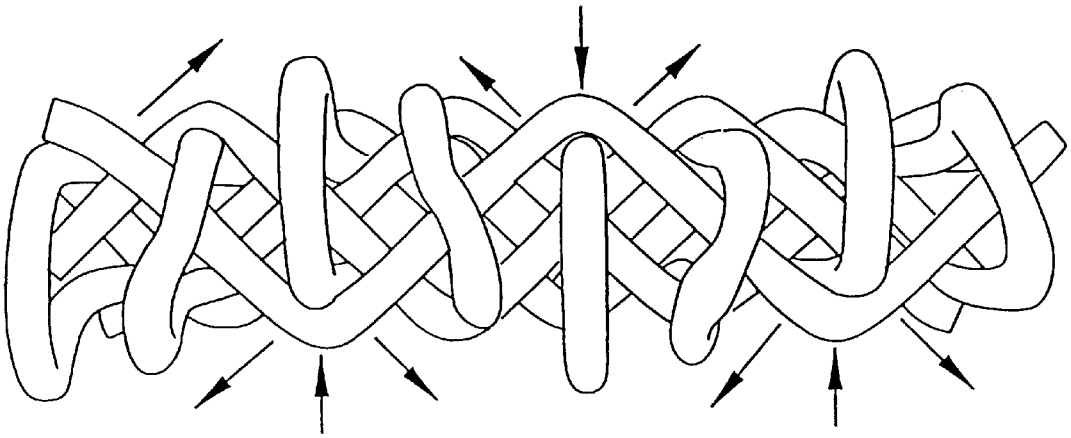
FIG. 2 (PRIOR ART)
FIG. 2 is an elevation view of the prior art end loops along the line 2—2 in FIG. 1.
Figure 3:
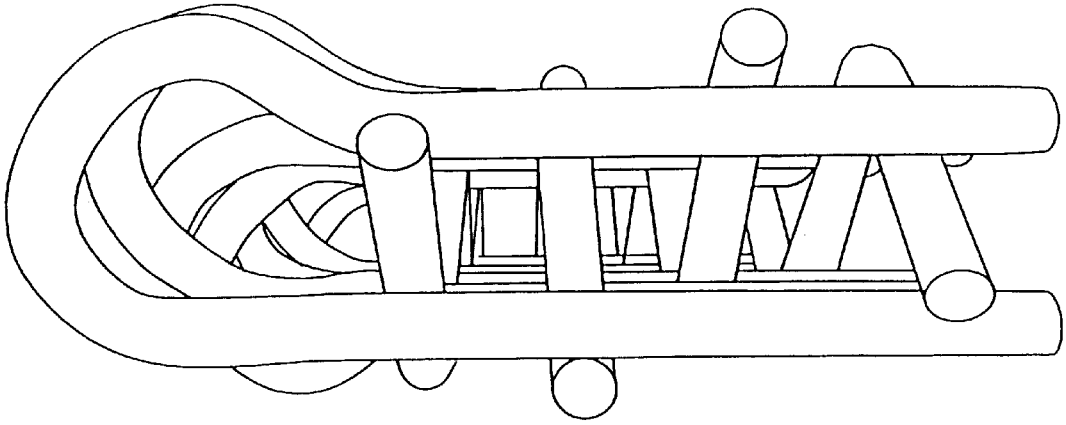
FIG. 3 (PRIOR ART)
FIG. 3 is a side elevation view of the prior art end loops along the line 3—3 in FIG. 1.

The preferred embodiment will be described with reference to the drawing figures where like numerals represent like elements throughout.

Figure 4:
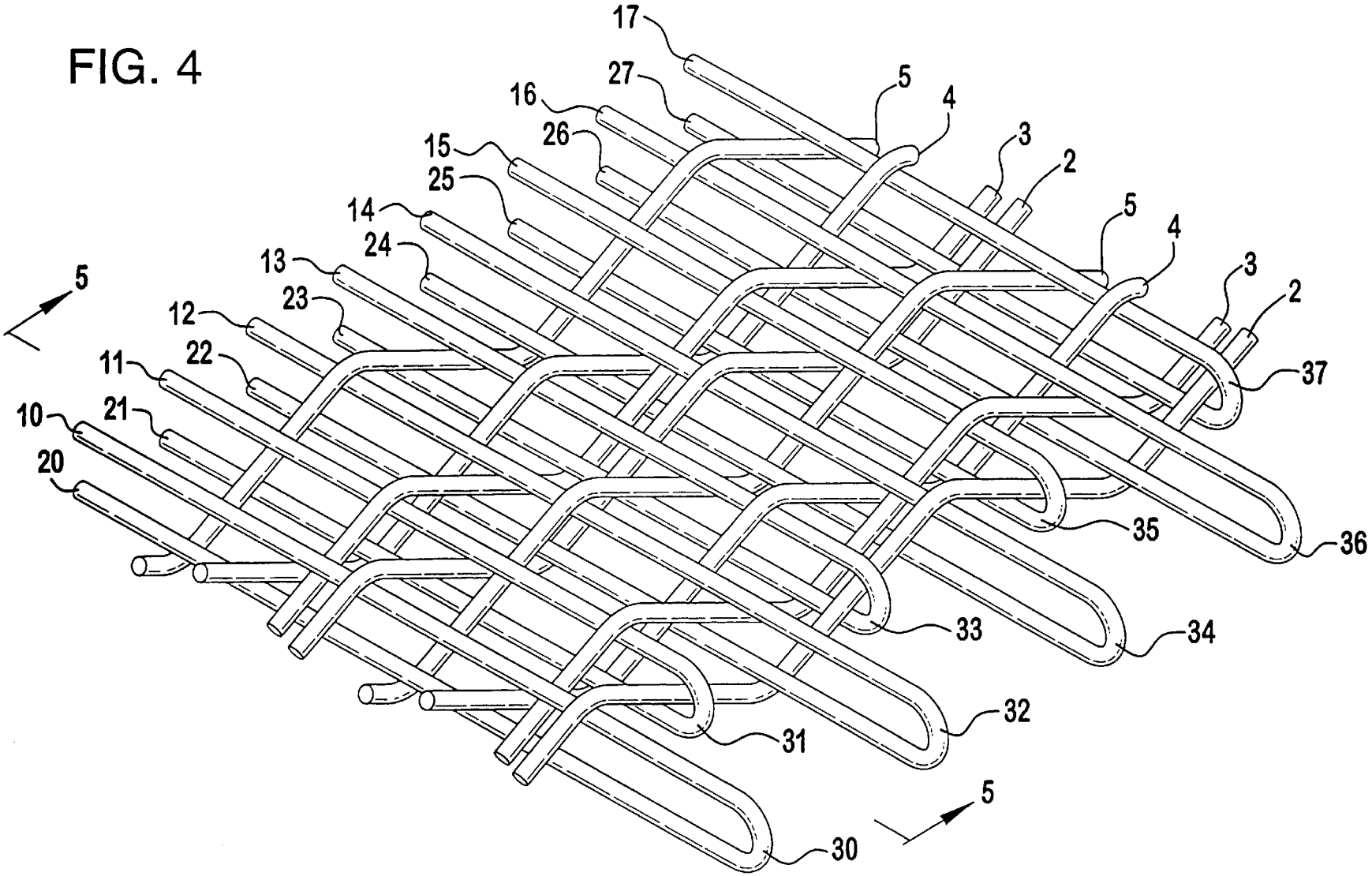
FIG. 4 is a schematic perspective view of a portion of the base fabric according to the present invention.

Referring to FIG. 4, it shows a portion of the base fabric 1 in accordance with the present invention. In the preferred embodiment, the base fabric 1 comprises a MD top layer 10–17 and a MD bottom layer 20–27 interwoven with CMD yarns 2–5. The CMD yarns 2–5 are woven in a repeated pattern where each CMD yarn 2–5 passes over, between, under, between with respect to the two layers of MD yarns. Every other MD top layer yarn 10, 12, 14, 16 is joined with the corresponding MD bottom layer yarn 20, 22, 24, 26 to form seam loops 30, 32, 34, 36 respectively. The remaining MD top layer yarns 11, 13, 15, 17 are joined with the corresponding MD bottom layer yarns 21, 23, 25, 27 to form integral fabric edge tiebacks 31, 33, 35, 37 respectively. The integral fabric edge tiebacks 31, 33, 35, 37 wrap around the end warp yarn 2, thereby forming an integral fabric edge or tieback inside the loop area. Although the MD yarns are referred to as upper and lower layer yarns, in the endless woven fabric the upper and lower layer yarns are continuous yarns joined by the seam or tieback portions. The continuous nature of the yarns is generally known to those skilled in the art and is described in U.S. Pat. No. 3,815,645.

Figure 8:
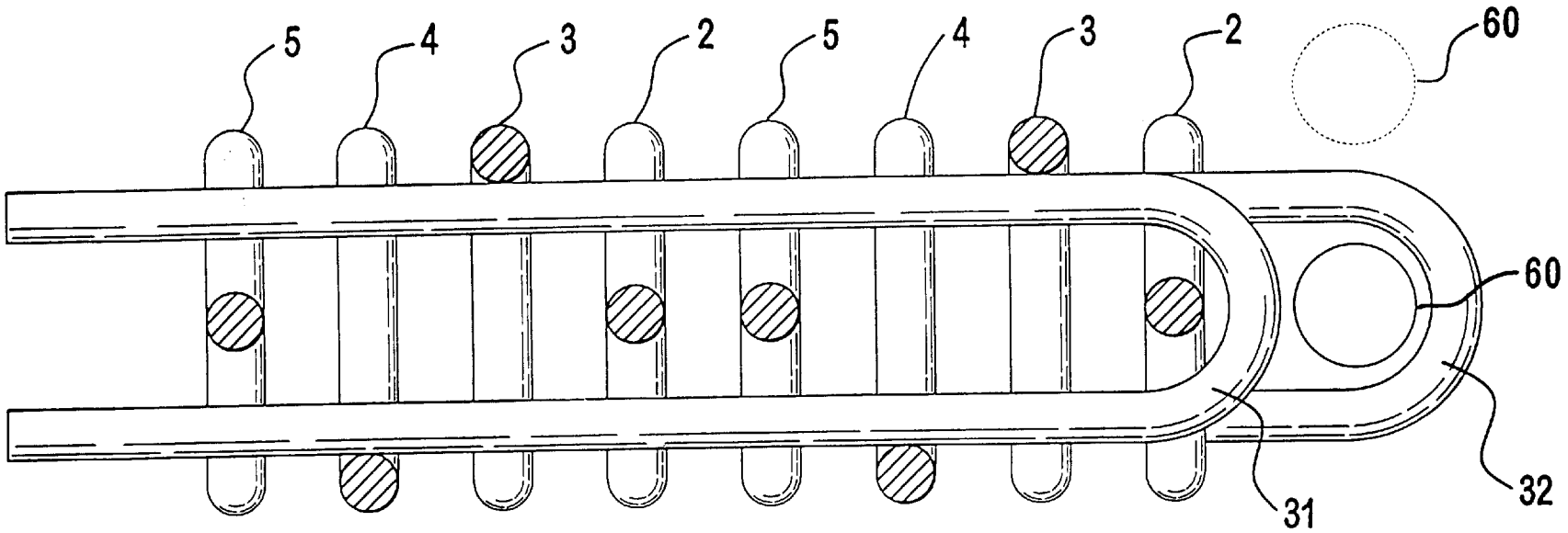
FIG. 8 is a side elevation of a portion of the fabric as it is woven on a loom.

Referring to FIG. 8, the seam loops 30, 32, 34, 36 are preferably formed by weaving the respective MD yarns around a forming wire 60 which is removed after weaving. To form the integral tiebacks, the forming wire 60 is shedded to a non-weaving position (shown in phantom) and the respective MD yarns are woven around the end CMD yarn 2.

Figure 5:
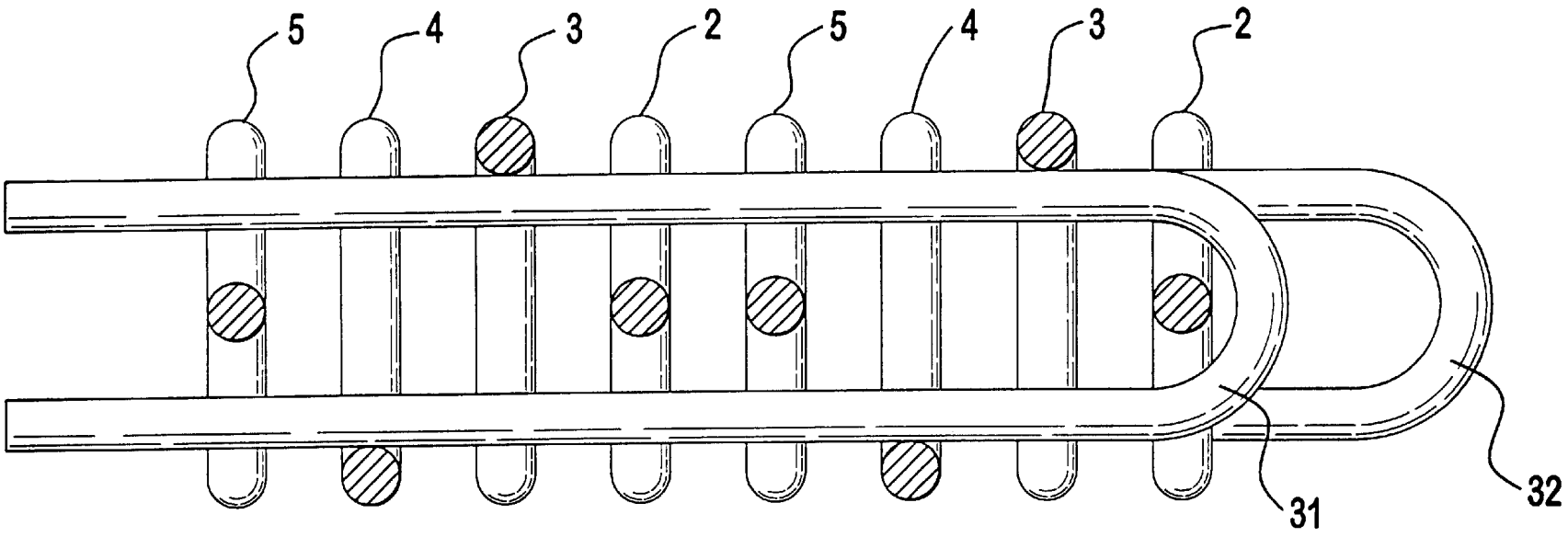
FIG. 5 is a side elevation view of a portion of the base fabric taken along line 5—5 in FIG. 4.
Figure 6:
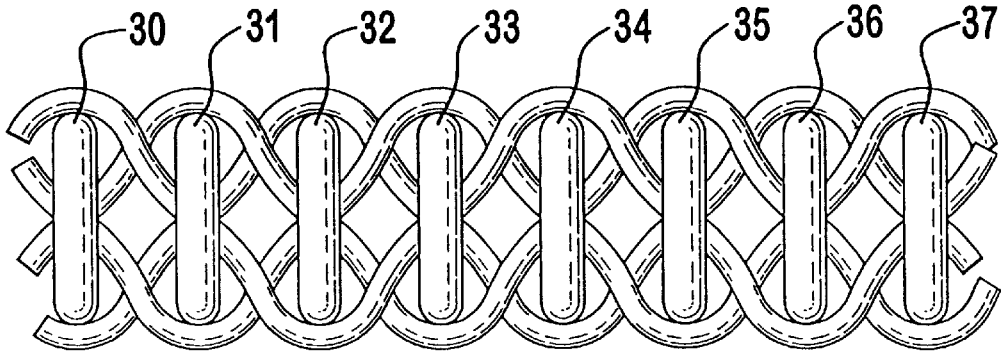
FIG. 6 is a front elevation view of a portion of the base fabric.
Figure 7:
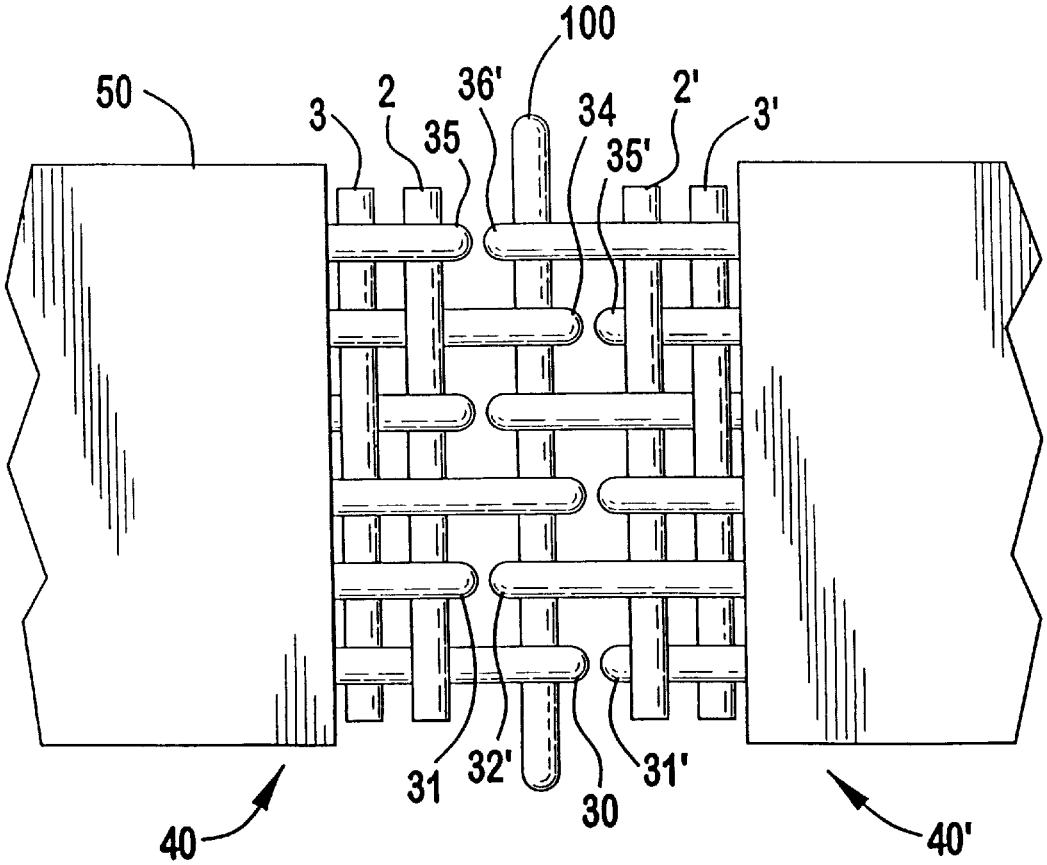
FIG. 7 is a top plan view of two end portions of the fabric joined together.

Because the integral fabric edge tiebacks balance the crimp force of the end warps 2 and 3, the crimp force applied to the seam loops 30, 32, 34, 36 is reduced. As a result, the seam loops 30, 32, 34, 36 are maintained in better vertical and horizontal alignment, as shown in FIGS. 5 and 6. In addition to the aligned loops 30, 32, 34 and 36, the base fabric 1 body is also maintained with aligned, planar upper and lower surfaces, as shown in FIGS. 5–7. This provides a more uniform base fabric, both in the seam area and in the fabric body.

As shown in FIG. 7, the opposite ends 40, 40' of the fabric are formed such that the seam loops 30, 32, 34, 36 of one end complement the integral fabric edge loops 31', 33', 35', 37' of the opposite end and vice versa. The vertical and horizontal alignment of the seam loops 30, 32, 34, 36 and 30', 32', 34', 36' allows the respective ends 40, 40' of the fabric to be intermeshed more efficiently and the pintle inserted more easily.

Another advantage of the preferred configuration is that the machine direction yarn density in the seam zone is similar to that of the body. Since the seam loops at one end align with the edge tiebacks of the other end, and vice versa, the number of seam loops aligned in the seam zone when the ends of the fabric are joined is essentially equal to the number of machine direction yarns across the entire fabric. This produces a more uniform permeability and flow profile in the fabric seam area.

As shown in FIG. 7, batt material 50 may be applied to one or both surfaces of the base fabric 1 as desired.

We claim:

1. An opened ended, endless woven papermaker's fabric having a plurality of longitudinal yarns and a plurality of transverse yarns woven in a selected weave pattern to form a fabric body and seaming loops, the fabric characterized by the longitudinal yarns being continuous yarns having a weave repeat having selected yarns woven as the seaming loops and selected yarns woven in the fabric body and defining a fabric edge whereby all of the longitudinal yarns define at least an upper planar surface and the longitudinal yarns forming the seaming loops are maintained in a generally stacked configuration.

2. The fabric of claim 1 wherein the seaming loops alternate with the fabric edge yarns in a 1 to 1 ratio.

3. The fabric of claim 1 wherein the seaming loops of each end of the fabric is aligned with the fabric edge yarns of the opposite end of the fabric when the ends of the fabric are seamed.

4. The fabric of claim 1 having a batt material anchored thereto.

5. A method of forming an open ended papermaker's fabric having integral seam loops and edge tiebacks comprising the steps of:

providing a system of longitudinal yarns including first layer longitudinal portions stacked over second layer longitudinal portions;

interweaving the longitudinal threads with a plurality of transverse yarns such that at least some of the transverse threads interweave with longitudinal portions in both layers; and selectively shedding a forming wire during interweaving of the longitudinal yarns to form seam loops and integral edge tiebacks at each end of the fabric, whereby the longitudinal yarns forming the seaming loops are maintained in a generally stacked configuration.

6. An opened ended, endless woven papermaker's fabric comprising a plurality of continuous machine direction (MD) yarns, including first MD layer portions stacked over second MD yarn layer portions, and a plurality of cross machine direction (CMD) yarns interwoven with portions of the MD yarns in both MD layers, the fabric characterized by:

selected MD yarns interwoven with the CMD yarns to define seaming loops and selected MD yarns interwoven with the CMD yarns to form integral edge tiebacks which assist in maintaining the seaming loops in a generally stacked configuration.

* * * * *